US006194118B1

(12) United States Patent
Miyamoto et al.

(10) Patent No.: US 6,194,118 B1
(45) Date of Patent: Feb. 27, 2001

(54) COLOR TONER AND MANUFACTURING METHOD THEREOF AND IMAGE FORMING METHOD USING THE COLOR TONER

(75) Inventors: Satoru Miyamoto; Nobutaka Kinoshita; Hiroshi Yaguchi, all of Shizuoka-ken (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/433,341

(22) Filed: Nov. 4, 1999

Related U.S. Application Data

(62) Division of application No. 09/075,881, filed on May 12, 1998, now Pat. No. 5,998,074.

(30) Foreign Application Priority Data

May 12, 1997 (JP) ..... 9-135765
May 11, 1998 (JP) ..... 10-142089

(51) Int. Cl.[7] ..... G03G 9/097
(52) U.S. Cl. ..... 430/137
(58) Field of Search ..... 430/137

(56) References Cited

U.S. PATENT DOCUMENTS

| | | | | |
|---|---|---|---|---|
| 4,840,863 | | 6/1989 | Otsu et al. | 430/110 |
| 5,250,996 | | 10/1993 | Sugizaki et al. | 430/109 |
| 5,272,034 | * | 12/1993 | Kawano et al. | 430/137 |
| 5,510,222 | | 4/1996 | Inaba et al. | 430/109 |
| 5,589,310 | * | 12/1996 | Uno et al. | 430/137 |
| 5,712,072 | | 1/1998 | Inaba et al. | 430/111 |
| 5,721,083 | | 2/1998 | Masuda et al. | 430/106 |
| 5,750,303 | | 5/1998 | Inaba et al. | 430/111 |

FOREIGN PATENT DOCUMENTS

| | | | | |
|---|---|---|---|---|
| 62-30259 | * | 2/1987 | (JP) | 430/137 |
| 1-202762 | * | 8/1989 | (JP) | 430/137 |
| 3-164750 | * | 7/1991 | (JP) | 430/137 |
| 6-043690 | * | 2/1994 | (JP) | 430/137 |

* cited by examiner

*Primary Examiner*—Roland Martin
(74) *Attorney, Agent, or Firm*—Oblon, Spivak, McClelland, Maier & Neustadt, P.C.

(57) ABSTRACT

A color toner comprises a binder resin, a coloring agent, a release agent and a charge controlling agent, wherein the release agent dispersed in the binder resin has an average particle diameter of from about 0.1 to about 2 $\mu$m and wherein a fixed color toner image, which is developed and fixed using the toner, has a Haze factor less than about 20% when the image has an image density of 1.5. The color toner produces images having good image qualities such as good color reproducibility.

5 Claims, 1 Drawing Sheet

COLOR TONER AND MANUFACTURING METHOD THEREOF AND IMAGE FORMING METHOD USING THE COLOR TONER

This application is a Divisional of application U.S. Ser. No. 09/075,881, filed on May 12, 1998, now U.S. Pat. No. 5,998,074.

BACKGROUND OF THE INVENTION

1. Field Of The Invention

The present invention relates to a color toner which is useful in image forming methods which include a step in which an electrostatic latent image is developed such as electrophotography, electrostatic recording and electrostatic printing, and to a method of manufacture of the color toner and to a method of image formation using the color toner.

2. Description of the Background

In image forming methods such as electrophotography, electrostatic recording and electrostatic printing, toner is generally used for developing an electrostatic latent image. The toner is required to be constituted of fine particles which are evenly charged and which have good fluidity. As to methods for developing an electrostatic latent image, two-methods are known, one of which is a developing method which employs a two-component developer, which includes a mixture of a toner and a carrier and the other of which is a developing method which uses a one-component developer which includes a toner but does not include a carrier. The developing method using a two-component developer has an advantage in that good images can be stably obtained, but the method has drawbacks which include that a carrier therein tends to deteriorate and the toner/carrier mixing ratio tends to change, resulting in deterioration of image qualities of the developed images.

In the image forming methods mentioned above, a developed toner image on a photoconductor is generally transferred to a transfer sheet and the transferred image is then fixed to obtain a fixed image. As for fixing methods, a heat roller fixing method is typically used in which a transfer sheet having a developed toner image thereon is heated while the sheet is pressed upon passage through a pair of heat rollers. This heat roller fixing method has an advantage in that a developed toner image can be quickly fixed, because the fixing method has high heat efficiency. However, a drawback of the method is the so-called offset problem which tends to occur in which an image which has transferred onto a transfer sheet, transfers instead to a heated roller and the image which has been transferred onto the roller is then transferred to another area of the transfer sheet or another transfer sheet, resulting in occurrence of undesirable images.

In attempting to solve these problems, Japanese Laid-Open Patent Publication No. 2-235067 discloses a developer which includes toner particles which include a release agent therein and thereon, each in a proper mixing ratio. The toner has releasability, however, the toner exhibits drawbacks such as poor fluidity and poor preservability, and has an uneven charge distribution which results in deterioration of image qualities, because the release agent is added onto the surface of the toner. In addition, Japanese Laid-Open Patent Publication No. 3-168649 discloses a developer including a toner in which a wax having low molecular weight, which serves as a release agent, is dispersed, by kneading with application of a large sheer strength is applied for a long time, in the binder resin of the toner so that the particle size of the dispersed wax is 1 $\mu$m or less. This technique tends to avoid the offset problem by controlling the particle diameter of the dispersed release agent, but has drawbacks in that the resultant toner has high manufacturing costs, because the kneading apparatus, which is capable of applying such high shear strength is limited and expensive, and the productivity of the method is low because of the long kneading times required.

Further, demands currently exist for color reproduction methods which provide images having good color image qualities. For example, color toners such as yellow, magenta and cyan toners, and optionally a black toner, are used to prepare full color electrophotographic images. It is preferred that these color toners exhibit good light reflection properties without exhibiting random reflection, and good transparency so that any mixed color image prepared has a desired color when the color toners are overlaid. In addition, the color toners preferably have a relatively small particle size, so that developed color toner images have good resolution and sharpness. Therefore, it is necessary to improve the dispersion of a coloring agent in a binder resin of a color toner.

A toner is generally formed of a binder resin, a coloring agent (a dye, a pigment, a magnetizable material and/or the like), and a charge controlling agent. These toner materials are melted and mixed by kneading, and then pulverized after solidification by cooling. The pulverized toner is then classified to prepare toner particles having a desired particle diameter. The thus obtained toner particles are mixed with an additive such as a colloidal silica to prepare a toner having good fluidity. Extrusion type continuous kneaders having a screw, two-roller mills, three-roller mills, kneaders which can heat and press, or the like have been conventionally used for kneading these toner materials.

In a color toner, the dispersion of a coloring agent in a binder resin depends on the kneading process employed in manufacture of the color toner, and when the dispersion is not satisfactory, the resultant toner is poorly colored and has poor clearness and transparency, resulting in serious deterioration of the color reproducibility of formed color images. In the kneading apparatus mentioned above, the dispersion of a coloring agent in a toner is not satisfactory, and, therefore, images having good image qualities cannot be obtained. In attempting to solve this problem, so-called toner master batch methods are disclosed. For example, Japanese Laid-Open Patent Publication No. 3-155568 discloses a toner manufacturing method which includes a step in which a toner master batch is first prepared by melting and kneading a mixture of a portion of a binder resin, a coloring agent and a solvent and then cooling and pulverizing the mixture, and another step in which the toner master batch and the remainder of the binder resin are melted and kneaded. This method tends to improve the dispersion of the coloring agent in the binder resin by adding a solvent, but the method has a drawback in that it takes a long time to obtain a desired color toner in which the particles of the coloring agent are dispersed in the binder resin in a desired particle size. This is because the mixture, including the solvent, has relatively low melt viscosity and, therefore, it is difficult to improve the dispersion of the coloring agent. In addition, Japanese Laid-Open Patent Publication No. 8-146662 discloses a toner which includes a plurality of coloring agents which are different from each other only with respect to particle size distribution. This toner requires at least two toner master batches which are prepared by changing kneading conditions so that each toner master batch includes a coloring agent having a different particle size distribution. However, the thus obtained toner cannot necessarily produce good images and in addition the method has a drawback of low productivity, because it is necessary to prepare at least two master batches to make the toner. Therefore, these toners are not satisfactory. Because of these reasons, a need exists for a color toner which is useful for developing an electrostatic latent image which can produce full color images having good image qualities and which can be effectively manufactured.

SUMMARY OF THE INVENTION

Accordingly, one object of the present invention is to provide a color toner which is useful for developing a latent electrostatic image, which is formed by electrophotography or the like, which can produce full color images having good color reproducibility and good resolution without undesired images such as white spots and offset images.

Another object of the present invention is to provide a color toner which does not scatter toner particles, which results in contamination of an image forming apparatus and the fouling of the background of formed images.

Yet another object of the present invention is to provide a method of manufacture of the color toner mentioned above.

Still another object of the present invention is to provide an image forming method by which full color images having good image qualities without white spots and the like can be prepared.

Briefly, these objects and other objects of the present invention as hereinafter will become more readily apparent can be attained by a color toner which comprises a binder resin, a coloring agent, a release agent and a charge controlling agent, wherein the release agent dispersed in the binder resin has an average particle diameter of from about 0.1 to about 2 $\mu$m and wherein a fixed color toner image, which is developed and fixed using the toner, has a Haze factor less than about 20% when the image has an image density of 1.5.

In another aspect of the invention, the toner is prepared by heating a mixture of the binder resin, the coloring agent and the release agent to a melt, and then kneading the mixture, followed by cooling and pulverizing the mixture to prepare a master batch of the toner. Thereafter, the master batch is combined with an additional amount of the binder resin or an additional binder resin and the charge controlling agent, and the mixture is heated to a melt, and then kneaded, cooled, and pulverized to complete the preparation of the toner.

In still another aspect of the invention, a full color image is formed by forming a latent electrostatic image on a photoconductor which is then subjected to reversal-development using one of the color toners of the present invention which is held on a magnetic brush in one of plural developing members which are installed in a developing unit which rotates so that an electrostatic latent image can be developed with any color toner included in the plural developing members.

BRIEF DESCRIPTION OF THE DRAWING

Various other objects features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE PREFERRED EMBODIMENTS

Figure 1:
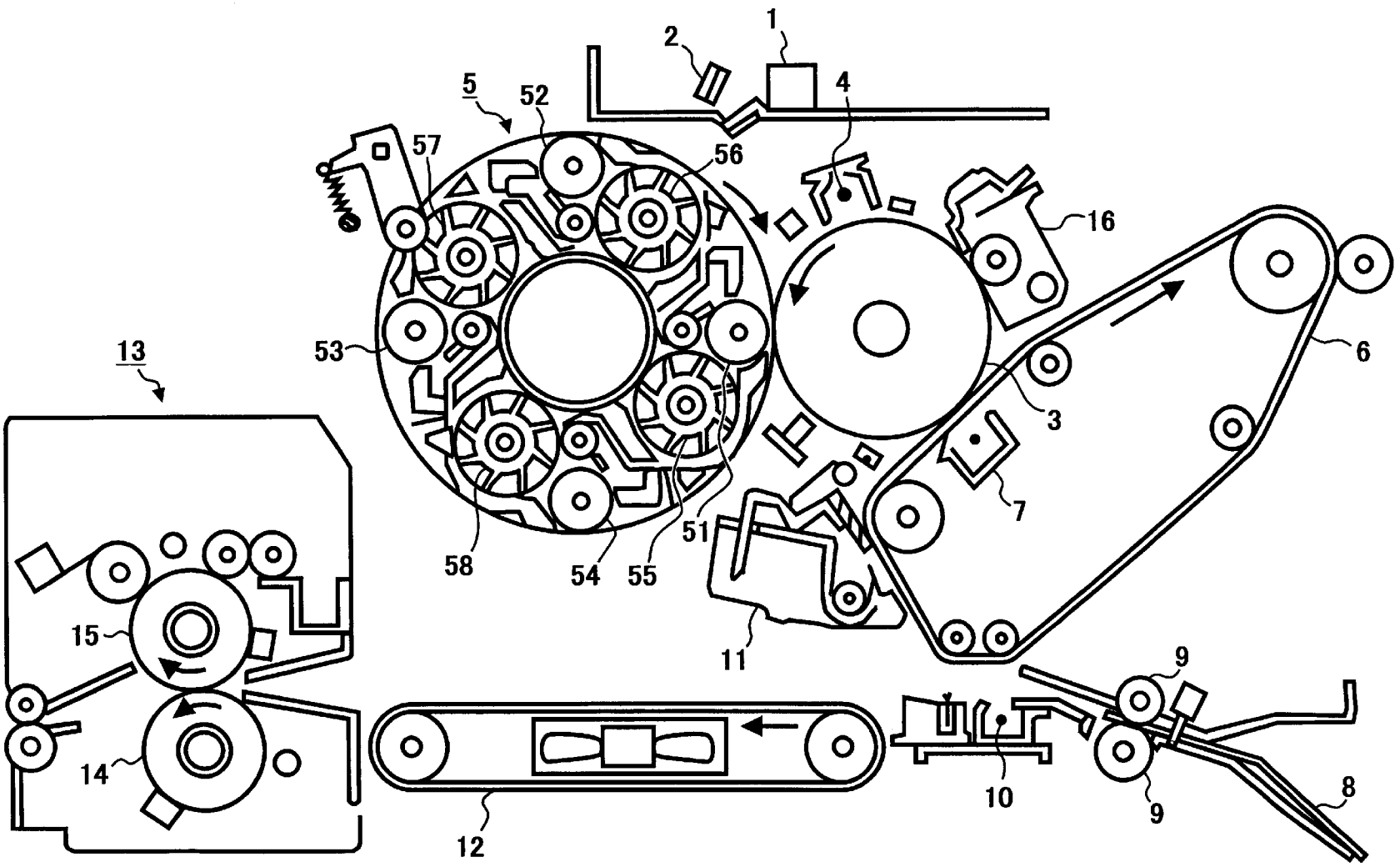
FIG. 1 is a partial cross-sectional view illustrating a toner image forming section of an embodiment of a full color image forming apparatus useful in the image forming method of the present invention.

In electrophotography, full color images can be generally obtained by using yellow, magenta and cyan toners and optionally a black toner. For example, a red image can be formed by overlying a magenta toner image on a yellow toner image, and a blue image can be formed by overlying a cyan toner image on a magenta toner image.

The present inventors have discovered the that color reproducibility of reproduced images depends on the state of dispersion of the release agent in toner particles and the Haze factor of the toner. That is, in a toner prepared from a binder resin, a coloring agent, a charge controlling agent and a release agent, the average particle diameter of the release agent in the toner particles preferably ranges from about 0.1 to about 2 $\mu$m, and more preferably from about 0.6 to about 1.3 $\mu$m, and the Haze factor of the fixed color toner image, which is obtained by fixation of the toner image prepared, is not greater than about 20% when the image has an image density of 1.5. By controlling the particle diameter of the release agent and the Haze factor of the toner image to preferred ranges, the resultant toner has good releasability, which results in prevention of the offset problem and the so-called "a nail-mark problem" in which nails used to separate an image receiving material from a fixing roller scratches images, because the toner image adheres to the fixing roller because of the poor releasability of the toner, resulting in formation of white streaks. In addition, the resultant toner has good transparency, good charging properties, good color properties and good preservability, and consequently the resultant images exhibit the desired image qualities even when the toner is used for a long time.

The average particle diameter of the coloring agent is preferably not greater than 1 $\mu$m, and more preferably from about 0.2 to about 0.7 $\mu$m in order to maintain good color reproducibility of the images which are formed. When the softening point of the binder resin is Tsr (° C.) and the flow starting temperature of the binder resin is Tfr (° C.), the release agent preferably has a melting point, Mpw, which is within the range:

$$(Tsr+5)(^\circ\ C.)<Mpw<(Tfr-5)(0C).$$

The particle diameter of the release agent and the coloring agent can be measured by a variety of methods. In the present invention, particle diameter is measured as follows:

(1) A toner particle is buried in a thermosetting resin and the resin is then crosslinked;

(2) The resin, including the toner particle, is sliced so as to have a thickness of 1000 Å with a microtome MT-6000 (manufactured by R. M. C. Inc.);

(3) The cross-section of the toner particle is observed with a transmittance electron microscope JSM-880 (manufactured by JEOL Ltd.); and (4) The image of the cross-section is analyzed with an image analyzing apparatus LUZEX 500 (manufactured by NIRECO Co., Ltd.) via a scanning converter unit to measure the particle diameter of the release agent and the coloring agent.

Image density and the Haze factor are measured as follows:

(1) Solid latent images, which have the same area but have different surface potential, are formed on a photoconductor and then the latent images are developed with a toner to form solid toner images whose toner quantities are changed;

(2) The solid toner images are then transferred to transfer paper and the transferred toner images are heated to fix the solid toner images;

(3) The image density of each fixed solid toner image is measured with a color-difference meter (Spectrodensitometer), X-rite. With this device the surface potential V1 of the photoconductor which attracts a certain amount of the toner whose image density is 1.5 when the toner is fixed, can be measured;

(4) A solid latent image having a surface potential of V1 is formed on the photoconductor, and the latent image is then developed with the toner to form a toner image;

(5) The toner image is transferred to an OHP (over head projection) sheet and the transferred image is then heated to fix the toner image whose image density is 1.5; and (6) The Haze factor of the fixed toner image is measured with an automatic Haze computer, HGM-2DP (manufactured by SUGA TEST INSTRUMENTS Co., Ltd.).

The present inventors have discovered that the offset problem can be avoided when the melting point of the release agent included in the toner is greater than about (Tsr+5)(° C.) and less than about (Tfr−5)(° C.), wherein Tsr and Tfr represent the softening point of the binder resin employed in the toner and the flow starting point of the binder resin, respectively.

By controlling the melting point of the release agent to within this range, the release agent melts while the binder resin of the toner softens. Consequently, the release agent with a proper particle diameter can be evenly dispersed in the binder resin. The toner of the present invention may include a plurality of release agents and binder resins. In this case, when the melting point of each release agent and the softening point and the flow starting point of each binder resin are in the same relationship as mentioned above, the offset problem can be avoided.

The toner of the present invention preferably has a volume average particle diameter not greater than about 9 μm, thereby allowing toner images to be prepared which exhibit good resolution and good sharpness.

The particle diameter distribution of toner particles can be measured by a variety of methods. In the present invention, a fine hole method (Coulter counter method) is used. A Coulter counter Model TA II (Coulter Electronics Inc.) is used as the measuring apparatus, and 1% sodium chloride solution is used as the electrolytic solution and an aperture of 100 μm is used as the aperture.

The toner of the present invention preferably has a charge rising property Z, i.e., Q20/Q600, greater than about 0.70. Such a good toner does not scatter, and results in the prevention of contamination of the developing unit and the image forming apparatus in which the toner is installed. The units Q20 and Q600 are defined as follows:

Q20 is the unit charge quantity of a toner when a developer, including a carrier and a toner at a toner content of 5% by weight, is agitated for 20 seconds; and Q600 is the unit charge quantity of the toner when the above-prepared developer is agitated for 600 seconds.

The unit charge quantity of a toner is measured as follows:

(1) A toner and a carrier are mixed to prepare a developer in which the toner content is 5% and the developer is agitated for 20 seconds (or 600 seconds) under the environmental conditions of room temperature and normal humidity;

(2) The developer is then placed in a container provided with a sieve having openings of 500 mesh;

(3) The toner in the developer in the container is then blown off to separate the toner from the carrier;

(4) The thus obtained toner is measured with respect to charge quantity Q (μC) and weight M (g), thereby preparing a unit charge quantity Q/M (μC/g).

In addition, if the toner has a coagulation rate of from about 4 to about 20%, the toner scattering can be further improved.

Measurements of the coagulation rate of a toner is performed by the following powder tester method:

(1) Two grams of a toner is set on a set of sieves, each having openings of 150 μm, 75 μm and 45 μm, respectively;

(2) The set of sieves is shaken to sieve the toner; and (3) The weight of each residual toner on the three sieves is measured thereby allowing the determination of the coagulation rate using the following equation:

$$\text{Coagulation rate } (\%) = (A+0.6\times B+0.2\times C)/2.0\times 100,$$

wherein A represents the weight of the residual toner on the sieve having an opening of 150 μm, B represents the weight of the residual toner on the sieve having an opening of 75 μm and C represents the weight of the residual toner on the sieve having an opening of 45 μm.

Further, when the color toners of the present invention are installed in a developing unit which can rotate and which includes a plurality of developing members each of which includes a magnetic brush in order to develop the latent image which forms on a photoconductor using a reversal-development method, the developed image has good image qualities without white spots and the like.

FIG. 1 is a partial cross-sectional view, which illustrates the toner image forming section of an electrophotographic full color image forming apparatus which is useful for the image forming method of the present invention.

A developing unit 5 includes four developing members. Each developing member includes a magnetic brush 51, 52, 53 and 54, and a stirrer 55, 56, 57 and 58.

Yellow, magenta, cyan and black toners are installed in their respective developing members in a developing unit 5. These developers are held on respective magnetic brushes 51, 52, 53 and 54. The developing unit 5 can rotate. A photoconductor 3 which rotates counterclockwise is charged with a charger 4 and then imagewise light is irradiated on the photoconductor 3 through a lens 1 and a mirror 2 to form an electrostatic latent image on the photoconductor 3. The latent image is then developed with a developer, for example a yellow developer, held on the magnetic brush 51 using a reversal-development method to form a yellow toner image on the photoconductor 3. The developed toner image is then transferred on an intermediate transfer member 6 using a charger 7 while the intermediate transfer member 6 rotates clockwise. The photoconductor 3 is then cleaned with a cleaner 16 after the yellow toner image is transferred to the intermediate transfer member 6, and another latent image is formed on the photoconductor 3. The developing unit rotates clockwise so that the magnetic brush 52 faces the photoconductor 3. The latent image is developed with a magenta toner held on the magnetic brush 52 using a reversal-development method to form a magenta toner image, and the magenta toner image is also transferred to the intermediate transfer member 6 having the yellow toner image thereon which has rotated one revolution so that the magenta toner image is exactly transferred to a predetermined position. A cyan and a black toner images are similarly formed on the intermediate transfer member 6 to form a full color toner image thereon. The thus obtained full color toner image is conveyed and then transferred to a receiving sheet 8, which is fed with a pair of rollers 9, using a charger 10. The receiving material having a full color image is then conveyed with a conveyer 12 and then fixed by passing through a fixing roller 14 and a press roller 15 in a fixing unit 13. The intermediate transfer member 6 is cleaned with a cleaner 11 after the toner image is transferred to the receiving sheet 8.

The toner of the present invention includes a binder resin, a coloring agent, a release agent and a charge controlling agent.

Suitable binder resins for use in the toner of the present invention include known resins which are used for conventional toners such as homopolymers of styrene and substituted styrene such as polystyrene, polychlorostyrene and polyvinyl toluene; styrene copolymers such as styrene/p-chlorostyrene copolymers, styrene/propylene copolymers, styrene/vinyl toluene copolymers, styrene/vinyl naphthalene copolymers, styrene/methyl acrylate copolymers, styrene/ethyl acrylate copolymers, styrene/butyl acrylate copolymers, styrene/octyl acrylate copolymers, styrene/methyl methacrylate copolymers, styrene/ethyl methacrylate copolymers, styrene/butyl methacrylate copolymers, styrene/methyl α-chloromethacrylate copolymers, styrene/acrylonitrile copolymers, styrene/vinyl ethyl ether copolymers, styrene/vinyl methyl ketone copolymers, styrene/butadiene copolymers, styrene/isoprene copolymers, styrene/acrylonitrile/indene copolymers, styrene/maleic acid copolymers and styrene/maleate copolymers; polymethyl methacrylate; polybutyl methacrylate; polyvinyl chloride; polyvinyl acetate; polyethylene; polypropylene; polyester; polyvinyl butyral; polyacrylates; rosins; modified rosins; terpene resins; phenolic resins; aliphatic or alicyclic resins; aromatic resins; chlorinated paraffin; paraffin waxes; and the like. These resins are used alone or in combination.

Suitable coloring agents for use in the toner of the present invention include known dyes and pigments which are used in conventional toners.

Specific examples of such dyes and pigments include Nigrosine dyes, Aniline Blue, chalco Oil Blue, Du Pont Oil Red, Quinoline Yellow, Methylene Blue chloride, Phthalocyanine Blue, Phthalocyanine Green, Hansa Yellow G, Rhodamine 6C Lake, Chrome Yellow, quinacridone, Benzidine Yellow, Malachite Green, Malachite Green hexalate, Rose Bengale, monoazo dyes, disazo dyes, trisazo dyes and the like.

Suitable charge controlling agents for use in the toner of the present invention include Nigrosine dyes, quaternary ammonium salts, polymers including an amino group, azo dyes including a metal atom, chain compounds of salicylic acid, phenolic compounds and the like.

Suitable release agents for use in the toner of the present invention include materials which preferably have a melting point of from about 70 to about 120° C. and more preferably from about 80 to about 110° C., in order to heat-effectively fix developed toner images and to prevent the offset problem.

Specific examples of such materials include synthetic waxes such as low molecular weight polyethylene and polypropylene; vegetable waxes such as candelilla wax, carnauba wax, rice wax, Japan wax and jojoba oil; animal waxes such as bees wax, lanolin and spermaceti; mineral waxes such as montan wax and ozokerite; and oils and fats such as hardened caster oil, hydroxystearic acid, fatty acid amides and phenolic fatty acid ester. These materials are employed alone or in combination.

The toner of the present invention may include additives such as a plasticizer and a resistance controlling agent, to control thermal, electrical or physical properties, and may further include a fluidity controlling agent to control the fluidity of the toner.

Suitable plasticizers for use in the toner of the present invention include dibutyl phthalate, dioctyl phthalate and the like.

Suitable resistance controlling agents include tin oxide, lead oxide, antimony oxide and the like.

Suitable fluidity controlling agents include colloidal silica, titanium oxide, aluminum oxide and the like. The fluidity controlling agents preferably have a particle diameter less than about 0.1 μm and are preferably treated with a silane coupling agent, a silicone oil or the like so as to be hydrophobic to the extent of having a hydrophobic degree greater than 40.

The content of binder resin, coloring agent, release agent and other components in the toner of the present invention range preferably from about 75 to about 93% by weight, from about 3 to about 10% by weight, from about 3 to about 8% by weight and from about 1 to about 7% by weight, respectively.

The toner of the present invention can be used as a toner for a one-component developer which includes a toner only to develop an electrostatic latent image and as a toner for a two-component developer which includes a toner and a carrier to develop an electrostatic latent image.

Suitable magnetizable materials for use as a carrier in the two-component developer of the present invention include metal oxides such as ferrite, iron-excess ferrite, magnetite, iron oxide; and metal powders such as iron, cobalt, nickel and alloys thereof.

These magnetizable materials may be coated with a resin or the like. Suitable resins useful for coating the surface of a carrier include styrene-acrylate copolymers, styrene-methacrylate copolymers, acrylic acid esters copolymers, methacrylic acid esters copolymers, silicone resins, fluorine-containing resins, polyamides, ionomer resins, polyphenylene sulfide resins and the like. These resins are used alone or in combination.

In the present invention, the mixing ratio of toner to carrier in a two-component developer ranges from about 0.5/100 to about 6.0/100 by weight.

As to the method of manufacture which is employed to prepare the toner of the present invention, various methods can be employed. However, the toner exhibits particularly good performance when the toner is manufactured by the method mentioned hereinafter.

Conventionally, large shear strength and long kneading times are required to manufacture a toner master batch which includes all of a binder resin, a coloring agent, a release agent and a charge controlling agent which constitute a toner. In addition, since a kneader such as a roll mill is normally used to manufacture the toner master batch, which cannot continuously manufacture the toner master batch, productivity of the toner is adversedly affected.

In the present invention, by preparing a toner master batch in which a three-component mixture of a binder resin, a coloring agent and release agent are preliminary melt and kneaded, a good master batch in which the coloring agent and the release agent are uniformly dispersed in the binder resin can be obtained. It is believed that the release agent serves as a dispersant for the coloring agent which generally has large oil absorption and, therefore, the coloring agent can be easily dispersed in the melted release agent, resulting in dramatic improvement of the dispersion of the coloring agent in the binder resin. Therefore, the toner of the present invention can be manufactured with apparatuses which can continuously knead a toner master batch, but cannot be used for manufacturing a conventional toner master batch because they cannot apply high shear strength to the toner master batch, resulting in increase of efficiency of toner production.

The thus obtained toner master batch is then completed by adding a charge controlling agent and an additional binder resin to the mixed materials, which may be the same as or different from the resin included in the toner master batch, and the mixture is melted and kneaded with a kneader such as a two-roller mill, a three-roller mill, a kneader capable of applying heat and pressure or the like to obtain a toner for a developer useful for full color reproduction by electrophotography or the like. By using this toner manufacturing method, the resultant toner is desirably colored even when the content of the coloring agent in the binder resin is relatively low, and thereby a toner which has good transparency and which can produce images having good image qualities can be obtained. In addition, by using this method, an extrusion type continuous kneader using a screw can be used for manufacturing the toner, resulting in increase of efficiency of toner production.

It is well-known that when a mixture of a binder resin and a coloring agent is melted and kneaded to prepare a toner master batch, a substantial shear strength is needed to finely disperse the coloring agent in the binder resin. In this case, if a release agent is added to the obtained toner master batch, and the mixture is further melted and kneaded to make a toner, the resultant toner is inferior to the toner prepared by the method of the present invention with respect to coloring properties and transparency of toner.

Further, it is necessary to prepare a toner having a relatively small particle diameter for obtaining images having good resolution, however, generally, the smaller the particle diameter of a toner including the release agent, the worse the fluidity and preservability of the toner. On the other hand, the toner of the present invention prepared by the method mentioned above can have good fluidity and preservability even when the toner has a volume average particle diameter less than about 9 $\mu$m. Therefore, in the present invention a good toner can be obtained which can produce images having good resolution while having good fluidity and preservability. The coloring agent is preferably included in the toner master batch in a high content in the range mentioned above to prepare a good toner in which the coloring agent is finely and uniformly dispersed.

When a toner master batch of the toner of the present invention is prepared, the preferred contents of the coloring agent and the release agent are respectively from about 10 to about 40 parts by weight and from about 10 to about 50 parts by weight per 100 parts by weight of the toner master batch. Such a toner master batch provides a toner which can effectively produce images having good image qualities and which has good fluidity and preservability.

The toner block which is obtained in the process is cooled and crushed with a crusher such as a hammer mill or the like, and in addition finely pulverized with a pulverizer such as a jet mill, a mechanical pulverizer or the like, and then classified with a classifier such as a jet air classifier, a mechanical classifier or the like to prepare a toner having a desired particle diameter. A fluidity controlling agent can be added to the resultant toner, if desired.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLE 1

A mixture of the following components was melted and kneaded with a two-axle kneader, and then cooled and crushed with a hammer mill to obtain a particulate yellow toner master batch:

Formulation of yellow toner master batch (Tsr+5<Mpw<Tfr−5)

| | |
|---|---|
| Polyester resin (binder resin) (Tsr = 75 and Tfr = 110° C.) | 10.0 |
| Low molecular weight polypropylene (release agent) (Mpw = 85° C.) | 8.0 |
| C.I. Pigment Yellow 17 (coloring agent) | 3.5 |

The prepared particulate yellow toner master batch was combined with 73.5 parts of the same polyester resin as included in the master batch and 5.0 parts of a salicylate compound serving as a charge controlling agent, and then melted and kneaded with a two-axle kneader. The mixture was then cooled and pulverized with a jet mill, and classified to obtain fine yellow particles having a volume average particle diameter of 12 $\mu$m. One hundred (100) parts of the yellow particles were then combined with 0.5 parts of a hydrophobic silica to prepare a yellow toner which is useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 $\mu$m. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 $\mu$m.

EXAMPLE 2

A mixture of the following components was melted and kneaded with a two-axle kneader, and then cooled and crushed with a hammer mill to prepare a particulate yellow toner master batch:

Formulation of yellow toner master batch (Tsr+5<Mpw>Tfr−5)

| | |
|---|---|
| Polyester resin (binder resin) (Tsr = 63 and Tfr = 87° C.) | 10.0 |
| Polyethylene (release agent) (Mpw = 85° C.) | 8.0 |
| C.I. Pigment Yellow 17 (coloring agent) | 3.5 |

The particulate yellow toner master batch was combined with 73.5 parts of the same polyester resin as included in the master batch and 5.0 parts of a salicylate compound serving as a charge controlling agent, and then melted and kneaded for 1 hour with a two-roller mill while applying a very high shear strength. The mixture was then cooled and pulverized with a jet mill, and classified to prepare fine yellow particles having a volume average particle diameter of 12 $\mu$m. One hundred (100) parts of the yellow particles were then combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 $\mu$m. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

EXAMPLE 3

A mixture of the following components was melted and kneaded with a two-axle kneader. Although being slightly isolated from the mixture, the release agent could be dispersed therein. The mixture was then cooled and crushed with a hammer mill to prepare a particulate yellow toner master batch:

Formulation of yellow toner master batch (Tsr+5>Mpw<Tfr−5. The content of the coloring agent was less than 10%)

| | |
|---|---|
| Polyester resin (binder resin) (Tsr = 81 and Tfr = 108° C.) | 30.0 |
| Carnauba wax (release agent) (Mpw = 80° C.) | 8.0 |
| C.I. Pigment Yellow 17 (coloring agent) | 3.5 |

The particulate yellow toner master batch was combined with 53.5 parts of the same polyester resin as included in the master batch and 5.0 parts of a salicylate compound serving as a charge controlling agent, and then melted and kneaded for 1 hour with a two-roller mill while applying a very high shear strength. The mixture was then cooled and pulverized with a jet mill, and classified to prepare fine yellow particles having a volume average particle diameter of 12 μm. One hundred (100) parts of the yellow particles were then combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to obtain a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to obtain a cyan toner and a black toner each of which had a volume average particle diameter of 12 μm.

EXAMPLE 4

The procedures for preparation of the toners in Example 1 were repeated to prepare yellow, magenta, cyan and black toners each of which had a volume average particle diameter of 8 μm except that the conditions of the classification process were changed.

EXAMPLE 5

A mixture of the following components was melted and kneaded for 2 hours with a two-roller mill, and then cooled and crushed with a hammer mill to prepare a particulate yellow toner master batch:

Formulation of yellow toner master batch (Tsr+5<Mpw<Tfr−5. The contents of each of the coloring agent and the release agent were less than 10%).

| | |
|---|---|
| Polyester resin (binder resin) (Tsr = 75 and Tfr = 110° C.) | 40.0 |
| Low molecular weight polypropylene (release agent) (Mpw = 85° C. | 8.0 |
| C.I. Pigment Yellow 17 (coloring agent) | 3.5 |

The particulate yellow toner master batch was combined with 43.5 parts of the same polyester resin as included in the master batch and 5.0 parts of a salicylate compound serving as a charge controlling agent, and then melted and kneaded with a two-axle kneader. The mixture was then cooled and pulverized with a jet mill, and classified to prepare fine yellow particles having a volume average particle diameter of 12 μm. One hundred (100) parts of the yellow particles were then combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

EXAMPLE 6

A mixture of the following components was melted and kneaded with a two-axle kneader, and then cooled and crushed with a hammer mill to obtain a particulate yellow toner master batch:

Formulation of yellow toner master batch (Tsr+5<Mpw<Tfr−5)

| | |
|---|---|
| Polyol resin (binder resin) (Tsr = 72 and Tfr = 98° C.) | 10.0 |
| Carnauba wax (release agent) (Mpw = 80° C.) | 8.0 |
| C.I. Pigment Yellow 17 (coloring agent) | 3.5 |

The particulate yellow toner master batch was combined with 73.5 parts of the same polyol resin as included in the master batch and 5.0 parts of a salicylate compound serving as a charge controlling agent, and then melted and kneaded with a two-axle kneader. The mixture was then cooled and pulverized with a jet mill, and classified to prepare fine yellow particles having a volume average particle diameter of 8 μm. One hundred (100) parts of the yellow particles were then combined with 0.5 parts of a hydrophobic silica to prepare a yellow toner as a yellow developer useful for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 8 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 8 μm.

EXAMPLE 7

A mixture of the following components was melted and kneaded with a two-axle kneader, and then cooled and crushed with a hammer mill to prepare a particulate yellow toner master batch:

Formulation of yellow toner master batch (Tsr+5<Mpw<Tfr−5)

| | |
|---|---|
| Styrene-acryl copolymer (binder resin) (Tsr = 63 and Tfr = 94° C.) | 10.0 |
| Low molecular weight polypropylene (release agent) (Mpw = 85° C.) | 8.0 |
| C.I. Pigment Yellow 17 (coloring agent) | 3.5 |

The particulate yellow toner master batch was combined with 73.5 parts of the same styrene-acryl copolymer as included in the master batch and 5.0 parts of a salicylate compound serving as a charge controlling agent, and then melted and kneaded with a two-axle kneader. The mixture was then cooled and pulverized with a jet mill, and classified to prepare fine yellow particles having a volume average particle diameter of 8 μm. On hundred (100) parts of the yellow particles were then combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 8 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 8 μm.

Comparative Example 1

A mixture of the following components was melted and kneaded with a two-axle kneader, and then cooled and crushed with a hammer mill to obtain a particulate yellow toner master batch:

Formulation of yellow toner master batch (this master batch did not include a release agent)

| | |
|---|---|
| Styrene-acryl copolymer (binder resin) (Tsr = 63° C. and Tfr = 94° C.) | 10.0 |
| C.I. Pigment Yellow 17 (coloring agent) | 3.5 |

The particulate yellow toner master batch was combined with 73.5 parts of the same styrene-acryl copolymer as included in the master batch, 5.0 parts of low molecular weight polypropylene (Mpw=85° C., and Tsr+5<Mpw<Tfr−5) serving as a release agent and 5.0 parts of a salicylate compound serving as a charge controlling agent, and then melted and kneaded with a two-axle kneader. The mixture was then cooled and pulverized with a jet mill, and classified to prepare fine yellow particles having a volume average particle diameter of 12 μm. One hundred (100) parts of the yellow particles were then combined with 0.5 parts of a hydrophobic silica to obtain a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

Comparative Example 2

A mixture of the following components was melted and kneaded with a two-axle kneader, and then cooled and crushed with a hammer mill to prepare a particulate yellow toner master batch:

Formulation of yellow toner master batch (Tsr+5<Mpw>Tfr−5)

| | |
|---|---|
| Polyester resin (binder resin) (Tsr = 63° C. and Tfr = 87° C.) | 10.0 |
| Low molecular weight polyethylene (release agent) (Mpw = 85° C.) | 8.0 |
| C.I. Pigment Yellow 17 (coloring agent) | 3.5 |

The particulate yellow toner master batch was combined with 73.5 parts of the same polyester resin as included in the master batch and 5.0 parts of a salicylate compound serving as a charge controlling agent, and then melted and kneaded with a two-axle kneader. The mixture was then cooled and pulverized with a jet mill, and classified to prepare fine yellow particles having a volume average particle diameter of 12 μm. One hundred (100) parts of the yellow particles were then combined with 0.5 parts of a hydrophobic silica to prepare a yellow toner useful for a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

Comparative Example 3

A mixture of the following components was melted and kneaded with a two-axle kneader to prepare a particulate yellow toner master batch, however, the release agent was isolated from the mixture and, therefore, a yellow toner master batch could not be obtained:

Formulation of yellow toner master batch (Tsr+5>Mpw<Tfr−5)

| | |
|---|---|
| Polyester resin (binder resin) (Tsr = 81° C. and Tfr = 108° C.) | 10.0 |
| Carnauba wax (release agent) (Mpw = 80° C.) | 8.0 |
| C.I. Pigment Yellow 17 (coloring agent) | 3.5 |

This procedure was repeated except that the coloring agent was replaced with a magenta or a cyan pigment, however, neither a magenta nor a cyan toner master batch could be obtained because the release agent was isolated from the mixture.

Comparative Example 4

A mixture of the following components was melted and kneaded with a two-axle kneader, and then cooled and crushed with a hammer mill to prepare a particulate yellow toner master batch:

Formulation of yellow toner master batch (Tsr+5<Mpw>Tfr−5)

| | |
|---|---|
| Polyol resin (binder resin) (Tsr = 72° C. and Tfr = 98° C.) | 10.0 |
| Fisher-Tropsch wax (release agent) (Mpw = 96° C.) | 8.0 |
| C.I. Pigment Yellow 17 (coloring agent) | 3.5 |

The particulate yellow toner master batch was combined with 73.5 parts of the same polyol resin as included in the master batch and 5.0 parts of a salicylate compound serving as a charge controlling agent, and then melted and kneaded with a two-axle kneader. The mixture was then cooled and pulverized with a jet mill, and classified to prepare fine yellow particles having a volume average particle diameter of 12 μm. One hundred (100) parts of the yellow particles were then combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

Comparative Example 5

A mixture of the following components was melted and kneaded with a two-axle kneader to prepare a particulate yellow toner master batch, however, the release agent was isolated from the mixture and, therefore, a yellow toner master batch could not be prepared:

Formulation of yellow toner master batch (Tsr+5>Mpw<Tfr−5)

| | |
|---|---|
| Polyol resin (binder resin) (Tsr = 72° C. and Tfr = 98° C.) | 10.0 |
| Polyethylene (release agent) (Mpw = 75° C.) | 8.0 |
| C.I. Pigment Yellow 17 (coloring agent) | 3.5 |

This procedure was repeated except that the coloring agent was replaced with a magenta or a cyan pigment, however, neither a magenta nor a cyan toner master batch could be prepared because the release agent was isolated from the mixture.

Comparative Example 6

A mixture of the following components was melted and kneaded with a two-axle kneader, and then cooled and crushed with a hammer mill to prepare a particulate yellow toner master batch:

Formulation of yellow toner master batch (Tsr+5<Mpw<Tfr−5. The contents of the coloring agent and the release agent were each less than 10%)

| | |
|---|---|
| Polyester resin (binder resin) (Tsr = 75° C. and Tfr = 110° C.) | 40.0 |
| Low molecular weight polypropylene (release agent) (Mpw = 85° C.) | 8.0 |
| C.I. Pigment Yellow 17 (coloring agent) | 3.5 |

The particulate yellow toner master batch was combined with 43.5 parts of the same polyester resin as included in the master batch and 5.0 parts of a salicylate compound serving as a charge controlling agent, and then melted and kneaded with a two-axle kneader. The mixture was then cooled and pulverized with a jet mill, and classified to prepare fine yellow particles having a volume average particle diameter of 12 μm. One hundred (100) parts of the yellow particles were then combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

Comparative Example 7

A mixture of the following components was melted and kneaded with a two-axle kneader while applying a relatively large shear strength compared to that in Example 1, and then cooled and crushed with a hammer mill to prepare a particulate yellow toner master batch:

Formulation of yellow toner master batch (Tsr+5<Mpw<Tfr−5)

| | |
|---|---|
| Polyester resin (binder resin) (Tsr = 75° C. and Tfr = 110° C.) | 10.0 |
| Low molecular weight polypropylene (release agent) (Mpw = 85° C.) | 8.0 |
| C.I. Pigment Yellow 17 (coloring agent) | 3.5 |

The particulate yellow toner master batch was combined with 73.5 parts of the same polyester resin as included in the master batch and 5.0 parts of a salicylate compound serving as a charge controlling agent, and then melted and kneaded for 2 hours with a two-roller mill. The mixture was then cooled and pulverized with a jet mill, and classified to prepare fine yellow particles having a volume average particle diameter of 12 μm. One hundred (100) parts of the yellow particles were then combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

Comparative Example 8

A mixture of the following components was melted and kneaded with a two-axle kneader, and then cooled, crushed with a hammer mill, pulverized with a jet mill and classified to prepare yellow particles having a volume average particle diameter of 12 μm:

Formulation of yellow particles (Tsr+5<Mpw<Tfr−5)

| | |
|---|---|
| Polyester resin (binder resin) (Tsr = 75° C. and Tfr = 110° C.) | 83.5 |
| Low molecular weight polypropylene (release agent) (Mpw = 85° C.) | 8.0 |
| C.I. Pigment Yellow 17 (coloring agent) | 3.5 |
| Salicylate compound (charge controlling agent) | 5.0 |

One hundred (100) parts of the yellow particles were combined with 0.5 parts of a hydrophobic silica to prepare a yellow toner useful as a yellow developer for a full color electrophotographic image forming apparatus.

The procedure for preparation of the yellow toner was repeated except that the coloring agent was replaced with 3.5 parts of a Rhodamine type pigment to prepare a magenta toner having a volume average particle diameter of 12 μm. In addition, the procedure for preparation of the yellow toner was repeated except that the coloring agent was replaced with 3.5 parts of a Phthalocyanine type pigment or 3.5 parts of a carbon black pigment to prepare a cyan toner and a black toner each of which had a volume average particle diameter of 12 μm.

The toners of the present invention prepared in Examples 1–7 and the comparative toners prepared in Comparative Examples 1, 2, 4, 6, 7 and 8 were evaluated by the methods mentioned below.

1. Toner Properties (1) Average particle diameter of coloring agent dispersed in toner:

The particle diameter of the coloring agent dispersed in a particle of each toner was measured by the method aforementioned. The measurements were performed 10 times, and the data obtained were averaged and the average particle diameters of the coloring agent dispersed in a toner particle of each toner were obtained.

(2) Average particle diameter of release agent dispersed in toner:

The particle diameter of the release agent dispersed in a particle of each toner was measured by the method aforementioned. The measurements were performed 10 times, and the data obtained were averaged and the average particle diameter of the release agent dispersed in a toner particle of each toner was obtained.

(3) Charge rising property Z of toner

The charge rising property Z of each toner was measured by the method aforementioned.

(4) Coagulation rate of toner

The coagulation rate of each toner was measured by the method aforementioned.

(5) Haze factor of toner

Haze factor of each toner was measured by the method aforementioned.

2. Image Qualities (1) Running test (I)

Each set of the color toners prepared in Examples 1–7 and Comparative Examples 1, 2, 4, 6, 7 and 8 was installed in a full color copier, PRETER 550, manufactured by Ricoh Co., Ltd. and a running test was performed in which one hundred thousand full color images were continuously produced. Initial images obtained in the running test and images after the running test were visually evaluated with respect to resolution, color reproducibility and white spots. In addition, initial images were also observed to determine whether an offset problem or a nail-mark problem occurred and after the running test, observations were made to determine whether fouling of background of formed images caused by toner scattering occurred.

(2) Running test (II)

EXAMPLE 8

A set of the color toners prepared in Examples 7 was installed in a full color copier, PRETER 300, manufactured by Ricoh Co., Ltd. and a running test was performed in which one hundred thousand full color images were continuously produced. Initial images obtained in the running test and images after the running test were visually evaluated with respect to resolution, color reproducibility and white spots. In addition, initial images were also observed to determine whether an offset problem or a nail-mark problem occurred and after the running test, observations were made to determine whether fouling caused by toner scattering occurred.

The results are shown in Tables 1–3.

TABLE 1

| | Toner properties (yellow toner) | | | | |
|---|---|---|---|---|---|
| | Diameter of coloring agent (μm) | Diameter of release agent (μm) | charge rising property Z (%) | Coagulation rate (%) | Haze factor |
| Example 1 | 0.3 | 0.8 | 90 | 6 | 12 |
| Example 2 | 0.5 | 1.3 | 84 | 9 | 14 |
| Example 3 | 0.7 | 1.3 | 83 | 10 | 16 |
| Example 4 | 0.3 | 0.8 | 97 | 6 | 13 |
| Example 5 | 0.4 | 0.7 | 97 | 6 | 13 |
| Example 6 | 0.2 | 0.6 | 98 | 4 | 11 |
| Example 7 | 0.3 | 0.6 | 97 | 5 | 11 |
| Example 8 | 0.3 | 0.6 | 97 | 5 | 11 |
| Comparative Example 1 | 1.3 | 2.5 | 41 | 42 | 25 |
| Comparative Example 2 | 0.8 | 2.2 | 47 | 35 | 17 |
| Comparative Example 4 | 0.9 | 2.4 | 43 | 38 | 18 |
| Comparative Example 6 | 1.4 | 2.7 | 34 | 45 | 27 |
| Comparative Example 7 | 0.3 | 0.07 | 91 | 3 | 13 |
| Comparative Example 8 | 2.3 | 3.5 | 26 | 54 | 40 |

TABLE 2

| | Initial image qualities | | | | | |
|---|---|---|---|---|---|---|
| | Problem | | | Fouling | Color | |
| | Offset | Nail-mark | Resolution | (Toner scattering) | reproducibility | White spots |
| Example 1 | ◎ | ◎ | ○ | ◎ | ○ | ○ |
| Example 2 | ◎ | ◎ | ○ | ◎ | ○ | ○ |
| Example 3 | ◎ | ◎ | ○ | ◎ | ○ | ○ |
| Example 4 | ◎ | ◎ | ◎ | ◎ | ◎ | ○ |
| Example 5 | ◎ | ◎ | ○ | ◎ | ○ | ○ |
| Example 6 | ◎ | ◎ | ◎ | ◎ | ◎ | ○ |
| Example 7 | ◎ | ◎ | ◎ | ◎ | ◎ | ○ |
| Example 8 | ◎ | ◎ | ◎ | ◎ | ◎ | ◎ |

TABLE 2-continued

| | Problem | | Initial image qualities | | | |
|---|---|---|---|---|---|---|
| | Off-set | Nail-mark | Resolu-tion | Fouling (Toner scattering) | Color reproduci-bility | White spots |
| Comparative Example 1 | ○ | ○ | Δ | Δ | X | Δ |
| Comparative Example 2 | ○ | ○ | Δ | Δ | Δ | Δ |
| Comparative Example 4 | ○ | ○ | Δ | Δ | Δ | Δ |
| Comparative Example 6 | ○ | ○ | Δ | Δ | X | Δ |
| Comparative Example 7 | ○ | X | Δ | ○ | Δ | ○ |
| Comparative Example 8 | ○ | ○ | Δ | Δ | X | Δ |

⊙: excellent
○: good
Δ: slightly bad
X: bad

TABLE 3

| | Image qualities after running test | | | |
|---|---|---|---|---|
| | Resolution | Fouling (Toner scattering) | Color reproducibility | White spots |
| Example 1 | ○ | ⊙ | ○ | ○ |
| Example 2 | ○ | ⊙ | ○ | ○ |
| Example 3 | ○ | ⊙ | ○ | ○ |
| Example 4 | ⊙ | ⊙ | ⊙ | ○ |
| Example 5 | ○ | ⊙ | ○ | ○ |
| Example 6 | ⊙ | ⊙ | ⊙ | ○ |
| Example 7 | ⊙ | ⊙ | ⊙ | ○ |
| Example 8 | ⊙ | ⊙ | ⊙ | ⊙ |
| Comparative Example 1 | Δ | X | X | X |
| Comparative Example 2 | Δ | X | X | X |
| Comparative Example 4 | Δ | X | X | X |
| Comparative Example 6 | Δ | X | X | X |
| Comparative Example 7 | Δ | Δ | Δ | Δ |
| Comparative Example 8 | Δ | X | X | X |

⊙: excellent
○: good
Δ: slightly bad
X: bad

The results in Tables 1–3 clearly indicate that the average particle diameter of the release agents dispersed in the toners of the present invention is from 0.1–2 $\mu$m and the Haze factor of an image which is developed with each of the toners of the present invention and then fixed is less than 20% when the image density of the fixed image is 1.5, and thereby the toners of the present invention can stably produce images having good image qualities such as good color reproducibility and high resolution without undesired images even when used for long periods of time.

This application is based on Japanese Patent Application No. 9-135765, filed on May 12, 1997, herein incorporated by reference.

Having now fully described the invention, it will be apparent to one of ordinary skill in the art that many changes and modifications can be made thereto without departing from the spirit and scope of the invention as set forth therein.

What is claimed as new and is intended to be secured by Letters Patent is:

1. A method for manufacturing a color toner, comprising:

a) preparing a toner master batch consisting of a binder resin, a coloring agent and a release agent by:
   i) mixing said three materials thereby preparing a mixture (1);
   ii) melting mixture (1) by applying heat thereto;
   iii) kneading mixture (1);
   iv) cooling kneaded mixture (1) to solidify the mixture (1); and
   v) pulverizing kneaded mixture (1) thereby preparing a particulate toner master batch; and b) preparing the color toner consisting of said toner master batch, a binder resin and a charge controlling agent by:
   i) mixing these three materials thereby preparing a mixture (2);
   ii) melting mixture (2) by applying heat thereto; and
   iii) kneading mixture (2).

2. The method according to claim 1, wherein the content of each of the coloring agent and the release agent in mixture (1) ranges from about 10 to about 40 parts by weight and from about 10 to 50 parts by weight, respectively, per 100 parts by weight of mixture (1).

3. The method according to claim 1, wherein the release agent has a melting point of from about 70 to 120° C.

4. The method according to claim 1, wherein the coloring agent is a Nigrosine dye, Aniline blue, chalco Oil Blue, Du Pont Oil Red, Quinoline Yellow, Methylene Blue chloride, Phthalocyanine Blue, Phthalocyanine Green, Hansa Yellow G, Rhodamine 6C Lake, Chrome Yellow, quinacridone, Benzidine Yellow, Malachite Green, Malachite Green hexalate, Rose Bengale, a monoazo dye, a diazo dye or a trisazo dye.

5. The method according to claim 1, wherein the charge controlling agent is a Nigrosine dye, a quaternary ammonium salt, an amino group containing polymer, an azo dye, a salicylic acid chain compound or a phenolic compound.

* * * * *